US005617014A

United States Patent [19]

Danstrom

[11] Patent Number: 5,617,014

[45] Date of Patent: Apr. 1, 1997

[54] MULTIFUNCTION VOLTAGE REGULATOR

[75] Inventor: Eric J. Danstrom, Farmington Hills, Mich.

[73] Assignee: SGS-Thomson Microelectronics, Inc., Carrollton, Tex.

[21] Appl. No.: 283,073

[22] Filed: Jul. 29, 1994

[51] Int. Cl.[6] ..... G05F 1/40

[52] U.S. Cl. ..... 323/267; 323/266

[58] Field of Search ..... 323/266, 267; 307/31, 33, 38, 39

[56] References Cited

U.S. PATENT DOCUMENTS 4,739,236 4/1988 Burkenpos ..... 318/588

5,208,485 5/1993 Krinsky et al. ..... 323/267 X 5,446,367 8/1995 Pinney ..... 323/266

5,534,768 7/1996 Chavannes et al. ..... 323/267

*Primary Examiner*—Peter S. Wong

*Assistant Examiner*—Y. J. Han

*Attorney, Agent, or Firm*—Joseph C. Arrambide; Theodore E. Galanthay; Lisa K. Jorgenson

[57] ABSTRACT

A circuit and method for an integrated multifunction voltage regulator is disclosed. The integrated circuit features a voltage preregulator having a battery input and a Vcc output, a voltage bus for distributing the Vcc voltage, and a plurality of function blocks which are connected to the Vcc buss and are driven by the Vcc voltage. The function blocks include voltage regulators, protected battery switches, band gap voltage references, and reset circuits.

24 Claims, 1 Drawing Sheet

MULTIFUNCTION VOLTAGE REGULATOR

BACKGROUND OF THE INVENTION

1. Field of the Invention

This invention relates to voltage regulators, and more particularly to electronic circuits used to regulate voltages in automobiles and still more particularly to circuits for controlling function blocks in a multifunction voltage regulator used in automobiles.

2. Description of the Relevant Art

The problem addressed by this invention is encountered in harsh operating conditions for electronic systems, such as in the automobile industry where automobile engines are controlled by sophisticated process controllers. These controllers must operate in the automotive compartment and are thus exposed to wide fluctuations in temperature and voltage. In addition, automobile performance requirements have increased with tighter government emission requirements and fuel economy regulations, while customer expectations have required increased reliability. Automobile manufacturers have responded to the increasing demands by using more microcomputers and electronics and, to accomplish this response, they are requiring electronics manufacturers to provide circuits having smaller packages, higher degrees of integration, lower power consumption, and higher reliability, at a low cost.

To meet some of these demands, it is desirable to combine a 5 volt 1 milliamp standby regulator, a 12 volt 100 milliamp regulator, and a 5 volt 1.25 amp PWM current mode regulator into a single integrated circuit. However, problem in combining these functions onto one integrated circuit is that the layout of all the bias currents necessary to drive these functions becomes increasingly complicated as the number of functions increase.

FIG. 1 shows a typical prior art multifunction voltage regulator integrated circuit. In this integrated circuit, function block 1, function block 2, and function block 3 correspond to voltage regulators powered by a bias current generator 4 by way of bias currents such as $IB_1$ through $IB_6$. Typically, the bias current generator 4 is enabled through an enable function block 6 by either an IGN signal which is generated when an automobile is turned on, or an EN2 signal which is generated when a microprocessor is executing a power-down routine. When the bias current generator 4 is enabled, the function blocks 1, 2, and 3 convert a battery voltage Vbatt 8 and the bias currents generated by the bias current generator 4 into regulated voltage outputs, or functional signals such as generating reset signals and the like, depending upon the functions desired.

FIG. 1 shows the bias current generator 4 generating at least six bias currents $IB_1$, $IB_2$, $IB_3$, $IB_4$,$IB_5$, and $IB_6$, and driving at least three function blocks 1, 2, and 3. Even though FIG. 1 shows two bias currents for each function block, it is understood that more or less bias currents may be needed to drive a specific function. It is typical in the prior art for the current generator to produce eight bias currents. A limitation of this prior art circuit is that it becomes exceedingly complex to layout an integrated circuit as the number of bias currents and functions increase.

SUMMARY OF THE INVENTION

In light of the above, therefore, it is an object of the invention to simplify the layout of a voltage regulator.

It is still another object of the invention to eliminate the need to distribute multiple bias currents in a multifunction voltage regulator.

It is still another object of the invention to decrease the cost of a multifunctional voltage regulator by simplifying the layout.

These and other object, features, and advantages of the invention will be apparent to those skilled in the art from the following detailed description of the invention, when read with the drawings and appended claims.

DETAILED DESCRIPTION OF THE PREFERRED EMBODIMENT

Figure 1:
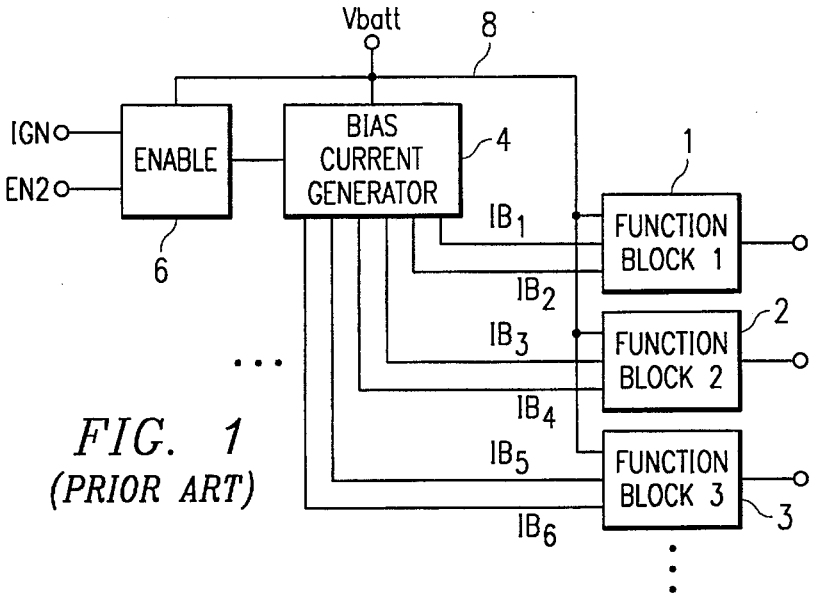
FIG. 1 (PRIOR ART)
FIG. 1 is an electrical schematic diagram of a voltage regulator, in accordance with the prior art.
Figure 2:
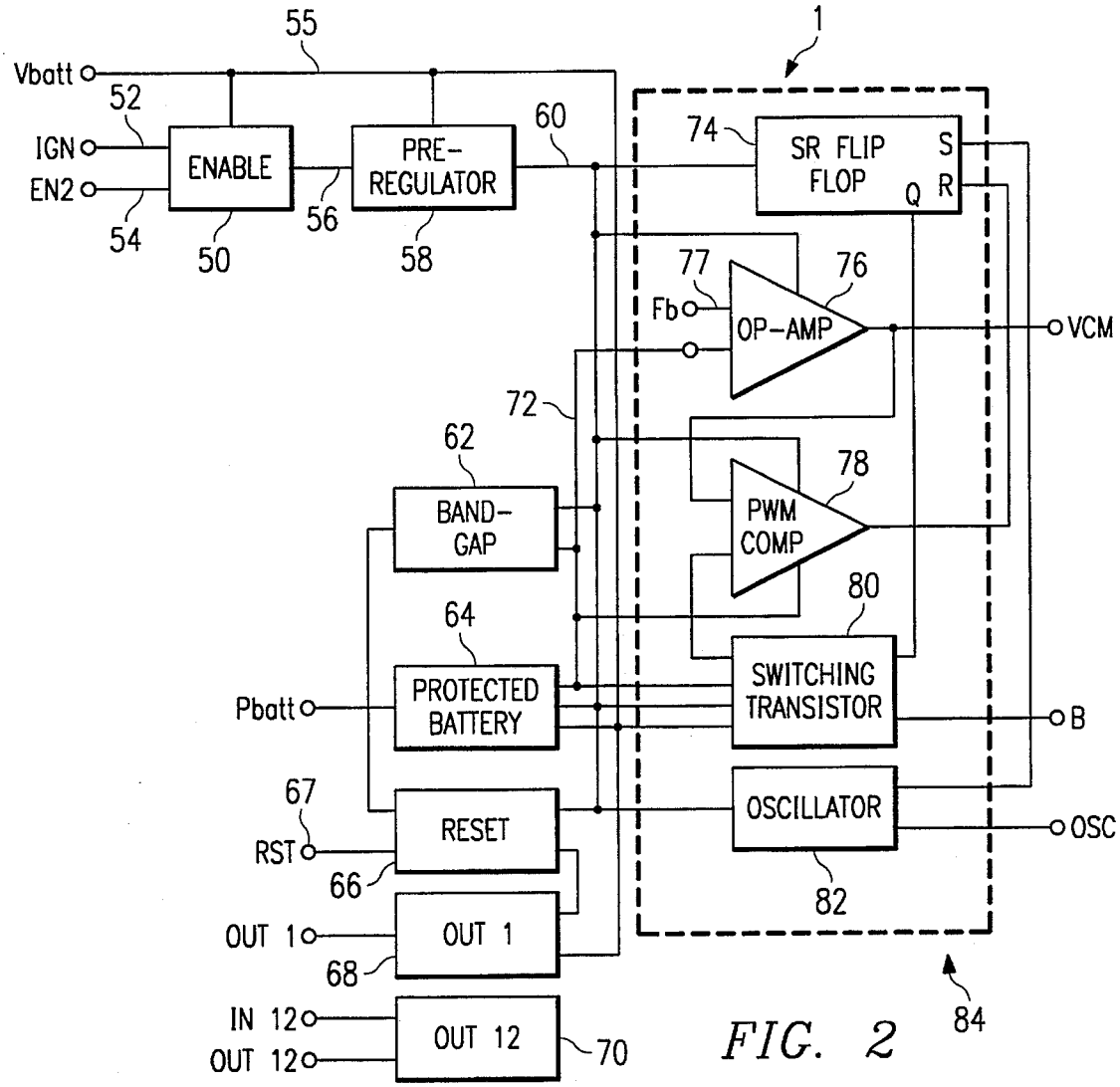
FIG. 2 is an electrical schematic diagram of a multifunction voltage regulator circuit, in accordance with a preferred embodiment of the present invention.

With reference now to FIG. 2, a multifunction voltage regulator designated with the reference number 1 according to an embodiment of the invention will now be described. The overall purpose of the regulator 1 is to power function blocks included in it when either an IGN signal or an EN2 signal is present. If one of the two signals is present, then a preregulator 58 provides a Vcc voltage to the functions in the circuit such as a band gap voltage reference 62, a voltage regulator 84, and the like. These function blocks convert the Vcc voltage into bias currents to power the particular function.

Again with reference to FIG. 2, the regulator 1 includes an enable function block 50 having an IGN input 52 and an EN2 input 54 for receiving respectively the IGN signal and the EN2 signal. The enable function block 50 is connected to a battery voltage bus designated Vbatt 55. The preregulator 58 is connected to the bus Vbatt 55 and to the enable function block 50. The preregulator 58 has an output connected to a preregulator voltage bus (PREG bus 60). The band gap voltage reference 62 is connected to the PREG bus 60, and to a reset function block 66, and has an output voltage connected to a BG bus 72. The regulator 1 also includes a protected battery switch function block 64 which is connected to the VBatt bus 55, to the PREG bus 60, and to the BG bus 72. The reset function block 66 is connected to the band gap voltage reference 62, to the PREG bus 60, and to an OUT1 function block 68 also included in the regulator 1. The OUT1 function block 68 is connected to the reset function block 66 and to the VBatt bus 55. The regulator 1 further includes the voltage regulator 84 provided by a switching regulator. The switching regulator 84 includes an SR Flip Flop 74 which is powered by the PREG 60 bus. The SR Flip Flop 64 has a first input designated S which is connected to an oscillator 82 and a second input designated R which is connected to an output of a PWM comparator 78. The SR Flip Flop 74 further has an output designated Q which is connected to a switching transistor 80. The oscillator 82, the PWM comparator 78 and the switching transistor 80 are included in the switching regulator 84, as shown in FIG. 2. The switching regulator 84 also includes an op-amp 76 which is powered by the PREG bus 60. The op-amp 76 has an input connected to the BG bus 72 and an output connected to an input of the PWM comparator 78. The PWM comparator 78 is powered by the PREG bus 60 and is connected to the BG bus 72. The PWM comparator 78 also has an input connected to the switching transistor 80. The switching transistor 80 is connected to the PREG bus 60, to the VBatt bus 55, to the BG bus 72, and has an output designated VSW. The oscillator 82 is powered by the PREG bus 60 and has an output designated OSC.

Functionally, the EN2 signal and IGN 54 are control signals to the preregulator 58 and are generated respectively by the on-board computer located in an automobile and by an ignition switch. If either the IGN signal or the EN2 signal is high level, then the enable function block 50 generates an enable signal 56 which turns on the preregulator 58. The preregulator 58 provides the internal Vcc voltage supply via PREG bus 60 for all the aforementioned function blocks, which are described in detail herein below.

The band gap voltage reference 62 on the BG bus 72 is a trimmed 2% voltage reference. This reference is 2% tolerance over the temperature range. The band gap voltage reference 62 is used as a reference voltage source for the switching regulator 84.

The operation of the 5 Volt switching regulator 84 is now described. The output of the oscillator 82 sets the SR Flip Flop 74 which turns on the switching transistor 80. The op amp 76 compares the voltage on a the feedback pin designated FB 77 to the band gap voltage. The output of the op-amp 76 and a voltage across a sense resistor RCS, not shown in FIG. 2 are compared by the PWM comparator 78. The output of the PWM comparator 78 resets the SR Flip Flop 74 and shuts off the switching transistor 80.

The protected battery switch function block 64 is a PNP switch that is enabled by either the IGN signal or the EN2. It limits current to 225 mA (typical). The protected battery switch function block 64 includes a thermal shutdown and a maximum output voltage. The maximum output voltage is 21 Volts typical. The protected battery switch function block 64 does not have an active clamp on the output.

The reset 66 function block 66 utilizes an open collector output. The reset function block 66 generates a "reset" pulse on a reset pin designated 67. When a the voltage to a microprocessor is unacceptably low, the "reset" is low and sinking 1 mA@1 V. When IGN signal and the EN2 signal are to a low level then RESET is sinking current.

The OUT1 function block 68 is a zener based reference. The maximum current out is specified at 1 mA. The nominal output voltage is 5.1 Volts. The output is not trimmed so the variation of output voltage is higher than a standard 5 volt regulator. The OUT1 function block 68 begins to drop out at 7 volts and the input-output differential is 2 Volts nominal, i.e. OUT1 is 3 Volts when Vbatt is 5 Volts. The maximum capacitive load on OUT1 is 10 uF for Iload=1 mA. The output is protected against short circuit to ground.

Finally, the regulator 1 includes an OUT12 function block 70 which is a 12 Volt regulator with an NPN pass element. Dropout voltage is 2.2 V over temperature and process. The OUT12 function block 70 has an input designated IN12. When the input IN12 exceeds 15 V (typical) the pass element turns on. OUT12 is limited to 200 mA typical.

In operation, the preregulator 58 generates approximately 5.2 volts for the PREG bus 60 responsive to either the IGN 52 signal or the EN2 signal enabling the enable function block 50. When the preregulator 58 is enabled, power is supplied, via the PREG bus 60, to the band gap voltage reference 62, to the protected battery switch function block 64, to the SR flip flop 74, to the op-amp 76, to the PWM comparator 78, to the switching transistor 80, and to the oscillator 82. Each of the aforementioned function block converts the voltage on the PREG bus into any bias currents which may be necessary to operate the function. Consequently, the multifunction voltage regulator is operational. Conversely, if neither the IGN the signal nor EN2 signal is activated, then the preregulator 58 is not enabled and no voltage is placed on the PREG buss 60 and the multifunctional voltage regulator is not operational.

This embodiment is advantageous over the prior art because it greatly simplifies the layout of a voltage regulator by replacing at least eight bias currents with one voltage bus. Without this simplification, the complexity of the layout of the bias currents would increase the cost of the integrated circuit by increasing the size of the die, or increasing the complexity of the manufacturing process.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as herein claimed.

We claim:

1. A multifunction voltage regulator implemented in an integrated circuit comprising:

an enable circuit having a plurality of inputs and having an output, for generating an enable signal on the output responsive to the inputs;

a voltage preregulator connected to the output of said enable circuit for receiving the enable signal, wherein said voltage preregulator has a battery voltage input and a Vcc voltage output for converting the battery voltage into the Vcc voltage;

a voltage bus connected to the output of the voltage preregulator for distributing said Vcc voltage; and a plurality of current source function blocks each having an input connected to said voltage bus for receiving said Vcc voltage, wherein the function blocks convert the Vcc voltage into a plurality of different bias currents to drive respective particular functions implemented by the function blocks.

2. The multifunction voltage regulator of claim 1 wherein one of said plurality of current source function blocks comprises a voltage regulator.

3. The voltage regulator of claim 2 wherein said voltage regulator comprises a 5 volt switching regulator.

4. The multifunction voltage regulator of claim 3 wherein said 5 volt switching regulator comprises an oscillator.

5. The multifunction voltage regulator of claim 3 wherein said 5 volt switching comprises a SR Flip Flop.

6. The multifunction voltage regulator of claim 3 wherein said 5 volt switching regulator comprises an op-amp.

7. The multifunction voltage regulator of claim 3 wherein said 5 volt switching regulator comprises a pulse width modulation comparator.

8. The multifunction voltage regulator of claim 3 wherein said 5 volt switching regulator comprises a switching transistor.

9. The multifunction voltage regulator of claim 1 wherein one of said plurality of current source function blocks comprises a protected battery switch.

10. The multifunction voltage regulator of claim 1 wherein one of said plurality of current source function blocks comprises a reset circuit.

11. The multifunction voltage regulator of claim 1 wherein one of said plurality of current source function blocks comprises a band gap voltage reference.

12. An automobile comprising an engine, engine control electronics, and a multifunction voltage regulator implemented in an integrated circuit, wherein the multifunction voltage regulator comprises:

an enable circuit having a plurality of inputs and having an output, for generating an enable signal on the output responsive to the inputs;

a voltage preregulator having a battery voltage input and a Vcc voltage output for converting the battery voltage into the Vcc voltage;

a voltage bus connected to the output of the voltage preregulator for distributing said Vcc voltage; and a plurality of current source function blocks each having an input connected to said voltage bus for receiving said Vcc voltage, wherein the function blocks convert the Vcc voltage into a plurality of different bias currents to drive respective particular functions implemented by the function blocks.

13. The multifunction voltage regulator of claim 12 wherein one of said plurality of current source function blocks comprises a voltage regulator.

14. The voltage regulator of claim 13 wherein said voltage regulator comprises a 5 volt switching regulator.

15. The multifunction voltage regulator of claim 14 wherein said 5 volt switching regulator comprises an oscillator.

16. The multifunction voltage regulator of claim 14 wherein said 5 volt switching comprises a SR Flip Flop.

17. The multifunction voltage regulator of claim 14 wherein said 5 volt switching regulator comprises an op-amp.

18. The multifunction voltage regulator of claim 14 wherein said 5 volt switching regulator comprises a pulse width modulation comparator.

19. The multifunction voltage regulator of claim 14 wherein said 5 volt switching regulator comprises a switching transistor.

20. The multifunction voltage regulator of claim 12 wherein one of said plurality of current source function blocks comprises a protected battery switch.

21. The multifunction voltage regulator of claim 12 wherein one of said plurality of current source function blocks comprises a reset circuit.

22. The multifunction voltage regulator of claim 12 wherein one of said plurality of current source function blocks comprises a band gap voltage reference.

23. A method for regulating a voltage generated by a multifunction voltage regulator implemented in an integrated circuit, the method comprising the steps of:

receiving a battery voltage;

sensing an enable input;

generating a Vcc voltage from the battery voltage responsive to said enable input;

busing said Vcc voltage to a plurality of current source function blocks; and producing a plurality of different bias currents responsive to said Vcc voltage to drive respective particular functions implemented by the function blocks.

24. The method of claim 23 wherein said plurality of current source function blocks provide:

a protected battery switch;

a reset signal;

a 5 volt switching regulator; and a band gap reference.

* * * * *